US011145196B2

(12) United States Patent
Lopez et al.

(10) Patent No.: US 11,145,196 B2
(45) Date of Patent: Oct. 12, 2021

(54) COGNITIVE-BASED TRAFFIC INCIDENT SNAPSHOT TRIGGERING

(71) Applicant: International Business Machines Corporation, Armonk, NY (US)

(72) Inventors: Rodolfo Lopez, Austin, TX (US); Louie A. Dickens, Tucson, AZ (US); Julio A. Maldonado, Austin, TX (US); Alexander D. Hames, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 603 days.

(21) Appl. No.: 15/910,968

(22) Filed: Mar. 2, 2018

(65) Prior Publication Data

US 2019/0272745 A1 Sep. 5, 2019

(51) Int. Cl.
*G08G 1/01* (2006.01)

(52) U.S. Cl.
CPC ..... *G08G 1/0133* (2013.01)

(58) Field of Classification Search
CPC ..... G07C 5/008; G07C 5/0841; G07C 5/02; G07C 5/0891; G07C 5/085; G07C 5/0866; G07C 5/00; G07C 5/0808; G07C 5/0816; G07C 5/08; G07C 5/006; G08G 1/166; G08G 1/205; G08G 1/052; G08G 1/0104; G08G 1/0112; G08G 1/0129; G08G 1/20; G08G 1/163; G08G 1/164; G08G 1/0133; G08G 1/0175; G08G 1/096725; G08G 1/162; G08G 1/16; G08G 1/0141;

(Continued)

(56) References Cited

U.S. PATENT DOCUMENTS 7,386,376 B2 6/2008 Basir et al.
10,430,883 B1 * 10/2019 Bischoff ..... G06Q 20/14

(Continued)

FOREIGN PATENT DOCUMENTS

CN 1302444 C * 2/2007
CN 1302444 C 2/2007

OTHER PUBLICATIONS

For U.S. Appl. No. 15/703,858 (cited in IDS Mar. 2, 2018) see EAST search; Non-Final Rejection made on U.S. Appl. No. 15/703,858 dated Dec. 6, 2019. (Year: 2019).*

(Continued)

*Primary Examiner* — Tuan C To
*Assistant Examiner* — Paul A Castro
(74) *Attorney, Agent, or Firm* — Scott S. Dobson

(57) ABSTRACT

A method for cognitive-based traffic incident snapshot triggering comprises acquiring data, via a first agent, from each of a plurality of local sensors. The first agent is configured to acquire the data from each of the plurality of local sensors in windows having a first window size. The method also comprises acquiring data, via a second agent, from each of a subset of the plurality of local sensors in windows having a second window size; detecting a pattern in the data acquired via the second agent, the pattern indicating a traffic incident; and in response to detecting a pattern indicating the traffic incident, aggregating all data acquired via the first agent from a time when the pattern was detected until (Continued)

motion of the vehicle stops with the pre-determined number of windows of data stored at the time when the pattern was detected.

15 Claims, 4 Drawing Sheets

(58) Field of Classification Search
CPC ..... G08G 1/096775; G08G 1/012; G08G 1/09626; G08G 5/025; G08G 1/0965; G08G 1/123; G08G 1/00; G08G 1/096741; B60W 40/09; B60W 2556/50; B60W 2530/14; B60W 2556/60; B60W 2420/42; B60W 10/184; B60W 10/20; B60W 30/095; B60W 50/14; B60W 2050/021; B60W 50/0205; B60W 30/09; B60W 30/0956; B60W 50/12; B60W 2540/30; B60W 50/0098; G06Q 40/08; G06Q 10/0635
See application file for complete search history.

(56) References Cited

U.S. PATENT DOCUMENTS

2002/0103622 A1* 8/2002 Burge ..... G06F 19/00 702/183
2013/0302758 A1* 11/2013 Wright ..... H04M 1/72412 434/65
2014/0300739 A1 10/2014 Mimar
2015/0087279 A1 3/2015 Dawson
2015/0145695 A1* 5/2015 Hyde ..... G08G 1/166 340/905
2016/0236638 A1* 8/2016 Lavie ..... H04N 7/185
2017/0032402 A1 2/2017 Patsiokas et al.
2017/0232963 A1* 8/2017 Pal ..... G08B 25/006 280/801.1

OTHER PUBLICATIONS

English machine translation to foreign Application CN1302444C, submitted by Applicant Mar. 2, 2018 (Year: 2021).*
Lopez et al., "Cognitive-Based Vehicular Incident Assistance," U.S. Appl. No. 15/703,858, filed Sep. 13, 2017.

* cited by examiner

COGNITIVE-BASED TRAFFIC INCIDENT SNAPSHOT TRIGGERING

BACKGROUND

When vehicles are involved in traffic incidents, it can be difficult to determine who is at fault, whether the driver was actually breaking the law, and/or the like. While vehicles may include sensors that capture data about the vehicle and its surroundings, identifying and capturing relevant sensor data to be used in addressing questions such as those mentioned above can also be difficult. For example, capturing and storing all data can result in high costs in terms of memory requirements and processing time to process all the data. However, selectively storing and processing only part of the sensor data can result in the exclusion of sensor data which would be relevant to aiding in the resolution of a traffic incident.

SUMMARY

Aspects of the disclosure may include a computer implemented method, computer program product, and system for cognitive-based traffic incident snapshot triggering. The method comprises acquiring data, via a first agent, from each of a plurality of local sensors located on a vehicle in response to detecting that the vehicle has begun moving. The first agent is configured to acquire the data from each of the plurality of local sensors in windows having a first window size to store a pre-determined number of windows of data based on when the windows of data are acquired. The method also comprises acquiring data, via a second agent, from each of a subset of the plurality of local sensors, wherein the second agent is configured to acquire the data from each of the subset of the plurality of local sensors in windows having a second window size; detecting a pattern in the data acquired via the second agent from the subset of the plurality of local sensors, the pattern indicating a traffic incident; and in response to detecting a pattern indicating the traffic incident, aggregating all data acquired via the first agent from a time when the pattern was detected until motion of the vehicle stops with the pre-determined number of windows of data stored at the time when the pattern was detected. The method also comprises outputting one or more recommendations related to the traffic incident to one or more users based on analysis of the aggregated data.

The above summary is not intended to describe each illustrated embodiment or every implementation of the present disclosure.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
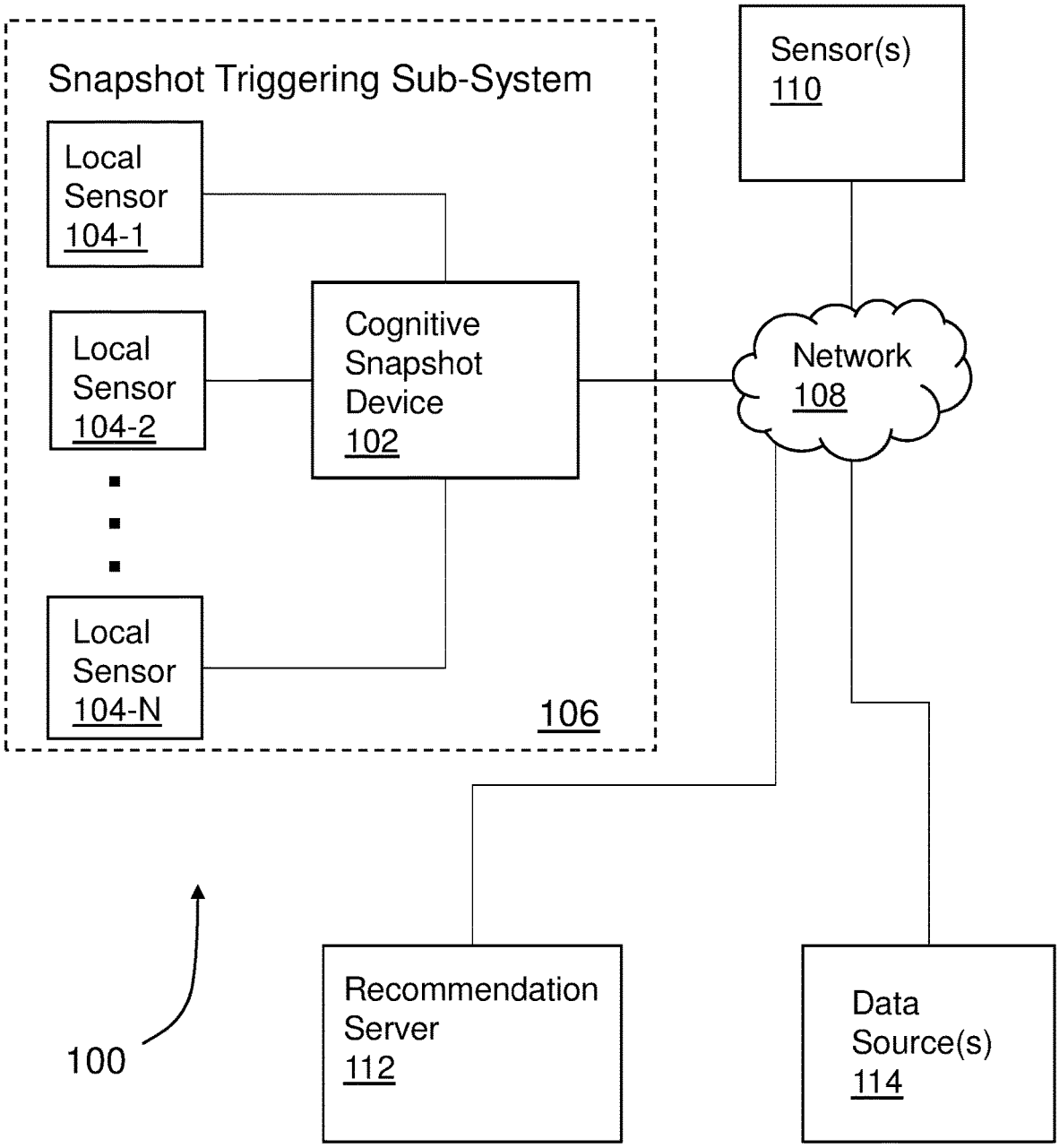
FIG. 1 is a high-level block diagram of one embodiment of an example system.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized, and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

FIG. 1 is a high-level block diagram of one embodiment of an example system 100. The embodiment of system 100 shown in FIG. 1 includes a snapshot triggering sub-system 106 coupled via a network 108 to a recommendation server 112, one or more data sources 114 and one or more sensors 110. The snapshot triggering sub-system 106 is located on a vehicle and configured to detect traffic incidents involving the vehicle on which it is located. The snapshot triggering sub-system 106 is configured to determine the type of traffic incident involved and to improve the collection of data through cognitive-based snapshot triggering as described herein. Through the cognitive-based snapshot triggering, the snapshot triggering sub-system 106 alters data collection parameters to capture data that is more likely relevant to determining a recommendation for a user. As a result, the functionality of the system 100 to provide recommendations is improved based on the improved collection of data. Additionally, the system 100 is configured, in some embodiments, to determine the type of traffic incident and to weight data inputs based on the type of traffic incident which enables the system to provide improved recommendations.

The network 108 can be implemented by any number of any suitable communications topologies (e.g., wide area network (WAN), local area network (LAN), Internet, Intranet, etc.). The communications network 108 can include one or more servers, networks, or databases, and can use a particular communication protocol to transfer data between the snapshot triggering sub-system 106 and the recommendation server 112, data sources 114, and/or the sensors 110. The communications network 108 can include a variety of types of physical communication channels or "links." The links can be wired, wireless, optical, or any other suitable media. In addition, the communications network 108 can include a variety of network hardware and software for performing routing, switching, and other functions, such as routers, switches, or bridges. Furthermore, it is to be understood that although the recommendation server 112, data sources 114 and the sensors 110 are depicted in the example of FIG. 1 as being communicatively coupled to the snapshot triggering sub-system 106 via the same network 108, for purposes of illustration, the various devices/nodes can be coupled to snapshot triggering sub-system 106 via separate networks, in other embodiments. Furthermore, it is to be understood that the snapshot triggering sub-system 106 can be coupled to the network 108 via one or more wireless communication networks, such as, but not limited to, Wi-Fi networks, cellular networks, Bluetooth® networks, and/or the like.

Furthermore, although the snapshot triggering sub-system 106 is depicted in the example of FIG. 1 as being coupled to the recommendation server 112, data sources 104 and sensors 110 via the network 108, it is to be understood that, in other embodiments, system 100 can include fewer or additional components. For example, in some embodiments, the system 100 comprises only the snapshot triggering sub-system 106. In other words, in such embodiments, the snapshot triggering sub-system 106 is not connected to any additional components via a network 108. Additionally, in some embodiments, at least part of the functionality of the recommendation server 112, described below, is incorporated into the cognitive snapshot device 102 of the snapshot triggering sub-system 106 and/or at least part of the data stored on the one or more data sources 114 is stored on a memory of the cognitive snapshot device 102.

The snapshot triggering sub-system 106 includes a plurality of local sensors 104-1 . . . 104-N (herein also referred to as local sensors 104) which are communicatively coupled to the cognitive snapshot device 102. The local sensors 104 are located on the same vehicle as the cognitive snapshot device 102. The cognitive snapshot device 102 is communicatively coupled to the plurality of local sensors 104 via one or more wired and/or wireless communication links. For example, wired communication links can be implemented using any suitable metallic communication medium (such as, but not limited to, twisted pair cables or coaxial cable) and/or optical communication medium (such as fiber optic cables) utilizing a suitable network protocol. Some example network protocols include, but are not limited to, Controller Area Network ("CAN"), Institute of Electrical and Electronics Engineers ("IEEE") 1394 family of standards, TTP/C, and Ethernet-based technologies. As used herein, Controller Area Network refers to an implementation of one or more of the family of ISO 11898/11519 families of standards, TTP/C refers to an implementation of the Time Triggered Protocol which conforms to the Society of Automotive Engineers ("SAE") Class C fault tolerant requirements, and Ethernet-based technologies refers to implementations of one or more of the family of IEEE 802.3 family of standards.

Similarly, wireless communication links can be implemented using any suitable wireless communication network, such as, but not limited to, a Wi-Fi network, a Bluetooth® network, a Radio Frequency Identification ("RFID") network, a ZigBee® connection based on the IEEE 802 standard, or an infrared connection. As used herein, a Wi-Fi network refers to a network based on any one of the Institute of Electrical and Electronics Engineers ("IEEE") 802.11 standards. Additionally, a Radio Frequency Identification ("RFID") network refers to RFID standards established by the International Organization for Standardization ("ISO"), the International Electrotechnical Commission ("IEC"), the American Society for Testing and Materials® ("ASTM"®), the DASH7™ Alliance, and EPCGlobal™. All standards and/or connection types include the latest version and revision of the standard and/or connection type as of the filing date of this application.

The plurality of local sensors 104 can include, but are not limited to, one or more motion sensors (e.g. speedometers, accelerometers, global positioning system (GPS) sensors, etc.), one or more imaging sensors (e.g. video cameras, infrared cameras, etc.), one or more audio sensors (e.g. microphones, sound detectors, etc.), one or more impact sensors (e.g. piezoelectric sensors, piezoresistive sensors, strain gauge sensors, etc.), one or more engine or diagnostic sensors (e.g. temperature sensors, throttle position sensors, crank position sensors, air flow sensors, fuel pressure sensors, etc.), and/or one or more environmental sensors configured to collect data regarding the environment surrounding the vehicle, such as, but not limited to road condition, wind speed, ambient temperature, etc.

Each of the local sensors 104 is located in a respective location on the vehicle. For example, a respective impact sensor can be located at each of a plurality of locations on the vehicle, such as in each bumper, in each door, etc. Similarly, respective imaging and audio sensors can be located in various respective locations on the vehicle, for example. Also, multiple sensors and sensor types can be used to obtain similar data in order to provide redundancy and improve accuracy, in some embodiments. For example, multiple different motion sensors can be used to collect speed data.

The data from the plurality of local sensors 104 is communicated to the cognitive snapshot device 102. As described in more detail below, the cognitive snapshot device 102 is configured to execute two agents to process the data received from the plurality of local sensors 104. The first agent is configured to collect and store all the received sensor data in timeframes or windows. The size of the timeframes can be configurable, in some embodiments. For example, in one embodiment, the timeframes are configured to be captured in 1 minute time increments. Additionally, the first agent is configured to store a preset number of increments, such as, for example, 5 increments, based on when the timeframes or windows of data were acquired. In some embodiments, the first agent uses an algorithm to store the most recent data over the course of time. For example, as a new timeframe increment is stored, the oldest timeframe increment of the preset number of increments is removed from memory. In other embodiments, other techniques can be used to determine which increments to maintain in memory, such as, but not limited to, a circular queue algorithm. Additionally, it is to be understood that, as with the size of the timeframe increments, the number of increments to store is configurable.

The second agent executed by the cognitive snapshot device 102 is configured to collect and analyze data from a subset of the local sensors 104. The subset of local sensors 104 includes sensors which provide data indicating a traffic incident. For example, in some embodiments, the subset of sensors 104 can include one or more audio sensors to detect siren sounds, one or more cameras to capture video of police lights, one or more impact sensors to detect a collision with another vehicle, etc. The second agent is also configured, in some embodiments, to collect and analyze data from the subset of the local sensors 104 in time increments. However, the time increments used by the second agent are different from the time increments used by the first agent, in some implementations. Furthermore, the time increments used by the second agent can be configured, in some embodiments. Also, similar to the first agent, the second agent collects and stores data using an algorithm, such as described above, to maintain the most recent data in memory. The second agent analyzes the data from the subset of the local sensors 104 to detect a pattern which indicates a traffic incident. The pattern can be based on audio data, image data, impact data, and/or a combination of the data collected from the subset of the local sensors 104.

Upon detection of a traffic incident by the second agent, the cognitive snapshot device 102 alters data collection by the first agent such that the first agent aggregates the data recorded from the time the vehicle begins stopping until the vehicle stops moving to the timeframe increments. In other words, rather than replacing the timeframe increments as discussed above. The first agent keeps the preset number of timeframe incidents stored just prior to detection of the traffic incident and aggregates data collected after detection of the traffic incident to the stored preset number of time-frame incidents. Thus, by altering the collection of data, the cognitive snapshot device 102 is able to collect data that is most relevant to providing recommendations regarding the traffic incident. For example, video data, motion data, etc. occurring just before, during, and after an accident can be recorded and stored without relevant data being replaced with the passage of time during and after the accident.

In addition, if the second agent determines that the pattern indicates an accident, the first agent is configured, in some embodiments, to collect data from vehicles in close proximity to the vehicle (e.g. the other vehicle(s) involved in the accident). This can include, for example, capturing video data of the other vehicles as well as communicating with the other vehicle to obtain sensor data from the other vehicle if the other vehicle is equipped with communication devices.

Upon detection of a traffic incident, the cognitive snapshot device 102 is also configured, in the example of FIG. 1, to collect data from one or more sensors 110 via the network 108. The one or more sensors 110 can include sensors in the vicinity of the traffic incident. For example, if the traffic incident is near a traffic signal, the traffic signal system may include cameras that capture images and video of the area around the traffic signal. In another example, responders to the traffic incident, such as law enforcement officers, emergency responders, and/or the like may have body cameras, or other sensors (e.g., oxygen sensors, smoke sensors, or the like) on their person. Other example sensors include radio frequency tag readers for reading and interpreting RFID tags and wireless signal sensors for capturing wireless signals emitted from wireless devices such as medical transponders.

The cognitive snapshot device 102, in this example, is also configured to obtain traffic data from one or more data sources 114 such as online databases. The one or more data sources 114 can include, for example, a vehicle company server, a Division of Motor Vehicle ("DMV") server, a weather server, etc. A vehicle company server can be used to access information associated with vehicles that are involved in the traffic incident. For instance, if a semi-truck that is carrying goods is involved in the traffic incident, the cognitive snapshot device 102 can query the vehicle company server for information related to what the goods the semi-truck is carrying, such as the chemical composition of the goods, the flammability of the goods, the weight of the goods, etc. Other data that can be accessed from the vehicle company server includes electronic manifests, driver information, source and destination information, etc.

A DMV server can be used to access information associated with drivers and/or vehicles that are involved in the traffic incident. The information may include identification information, background information (e.g., arrest records, previous citations, and/or the like), and/or the like. The DMV server can be maintained by a government agency and/or other entity that manages and maintains records for drivers and vehicles. The weather server can be used to access current weather information and/or future weather forecasts. The weather information may include temperature information, precipitation information, humidity information, wind information, and/or the like. The weather server can be maintained by a weather agency, a weather station, etc.

The cognitive snapshot device 102 can aggregate data collected from the local sensors 104, the sensors 110 and the one or more data sources 114. In some embodiments, the cognitive snapshot device 102 processes the data to determine one or more recommendations and output the one or more recommendations to at least one user. In other embodiments, such as depicted in FIG. 1, the cognitive snapshot device 102 provides the aggregated data to the recommendation server 112. The recommendation server 112 then analyzes the aggregated data to determine the one or more recommendations. The recommendation server 112 communicates the one or more recommendations to at least one user via the cognitive snapshot device 102.

The cognitive snapshot device 102 and/or the recommendation server 112 use cognitive computing processes that perform various machine learning and artificial intelligence algorithms on the data to determine recommendations particular to specific individuals at the traffic incident such as driver-specific recommendations, officer-specific recommendations, responder-specific recommendations, and/or the like. In this manner, the parties involved in the traffic incident can obtain real-time recommendations for responding to the traffic incident, such as determining who is at fault for an accident, determining what percentage a driver is at fault for an accident, whether an individual in the vehicle, e.g., a driver or a passenger, is injured and needs emergency care, whether the driver violated any traffic laws, and if so, which traffic laws were violated, etc. Additional details regarding example embodiments of cognitive processes for providing recommendations, as well as example data sources 114 and sensors 110 which can be accessed over the network 108 are discussed in co-pending U.S. patent application Ser. No. 15/703,858, which is incorporated herein by reference.

In addition, the cognitive snapshot device 102 is configured, in some embodiments, to determine the type of traffic incident based on the sensor data. Furthermore, in some such embodiments, the cognitive snapshot device 102 is configured to improve the computed recommendations by providing weights to data inputs based on the determined type of traffic incident, as discussed in more detail below. Thus, the snapshot triggering sub-system 106 enables improved functionality by altering the collection of sensor data as well as weighting the data based on the incident type. As such, recommendations provided by the snapshot triggering sub-system 106 are improved. An example cognitive snapshot device 102 for the snapshot triggering sub-system is discussed in more detail below.

Figure 2:
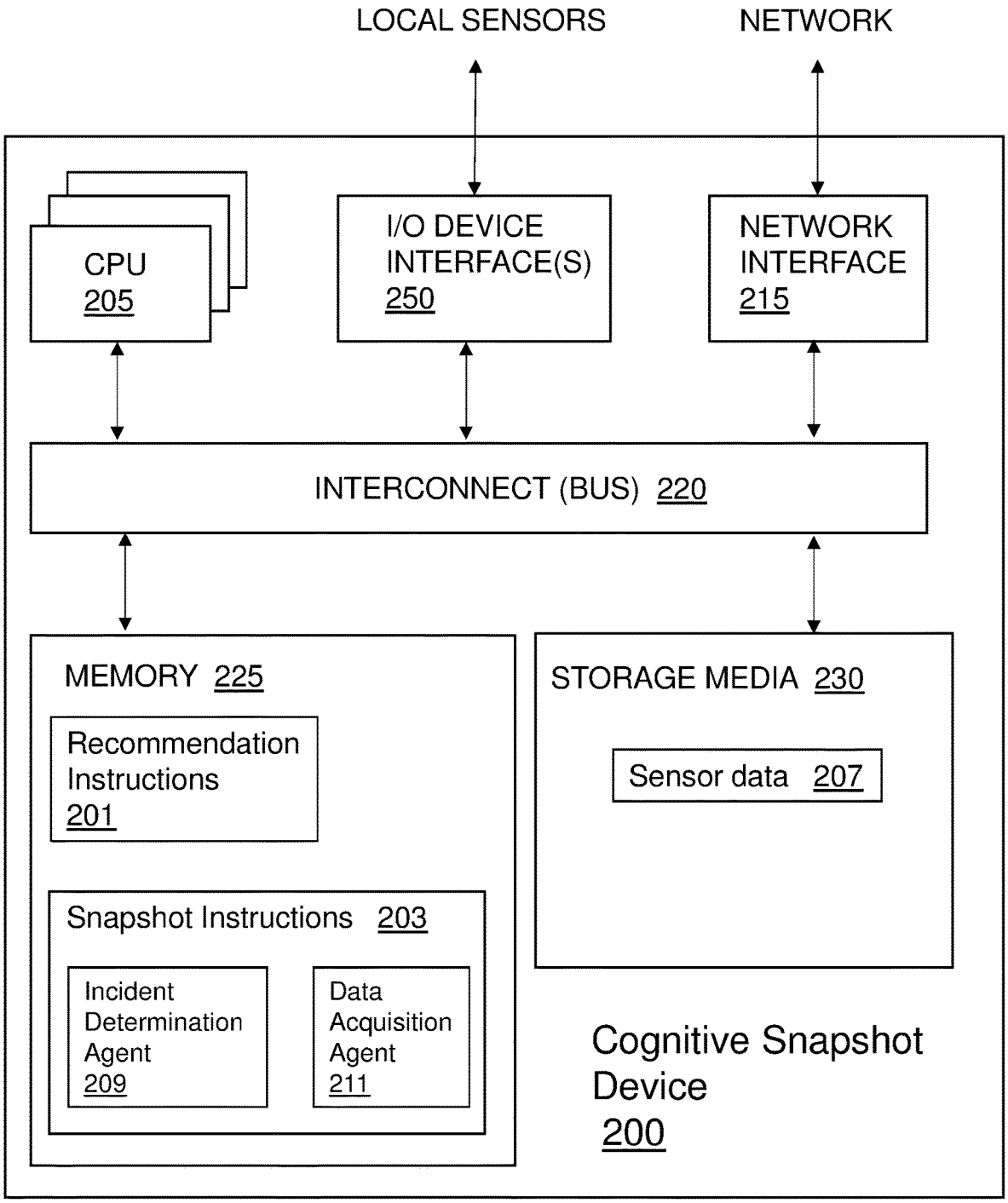
FIG. 2 is a block diagram of one embodiment of an example cognitive snapshot device.

FIG. 2 is a block diagram of one embodiment of an example cognitive snapshot device 200. In the example shown in FIG. 2, the cognitive snapshot device 200 includes a memory 225, storage 230, an interconnect (e.g., BUS) 220, one or more processors 205 (also referred to as CPU 205 herein), an I/O device interface 250, and a network interface 215.

Each CPU 205 retrieves and executes programming instructions stored in the memory 225 and/or storage 230. The interconnect 220 is used to move data, such as programming instructions, between the CPU 205, I/O device interface 250, storage 230, network interface 215, and memory 225. The interconnect 220 can be implemented using one or more busses. The CPUs 205 can be a single CPU, multiple CPUs, or a single CPU having multiple processing cores in various embodiments. In some embodiments, a processor 205 can be a digital signal processor (DSP). Memory 225 is generally included to be representative of a random access memory (e.g., static random access memory (SRAM), dynamic random access memory (DRAM), or Flash). The storage 230 is generally included to be representative of a non-volatile memory, such as a hard disk drive, solid state device (SSD), removable memory cards, optical storage, or flash memory devices. In an alternative embodiment, the storage 230 can be replaced by storage area-network (SAN) devices, the cloud, or other devices connected to the cognitive snapshot device 200 via the I/O device interface 250 or via a communication network coupled to the network interface 215.

In some embodiments, the memory 225 stores snapshot instructions 203 and the storage 230 stores sensor data 207. Additionally, in this example, the memory 225 stores recommendation instructions 201 which are configured to cause the CPU 205 to generate one or more recommendations based on the type of incident and collected data, as discussed above and described in more detail below with respect to FIGS. 3 and 4. However, it is to be understood that, in other embodiments, the cognitive snapshot device 200 does not include recommendation instructions 201 and recommendations can be generated by a remote device, as discussed above. Furthermore, although snapshot instructions 203 and recommendation instructions 201 are stored in memory 225 while sensor data 207 is stored in storage 230 in the example of FIG. 2, in other embodiments, the snapshot instructions 203, recommendation instructions 201, and sensor data 207 are stored partially in memory 225 and partially in storage 230, or they are stored entirely in memory 225 or entirely in storage 230, or they are accessed over a network via the network interface 215.

The snapshot instructions 203 cause the CPU 205 to execute an incident determination agent 209 and a data acquisition agent 211. The incident determination agent 209 is configured to sample sensor data from a subset of the local sensors in order to detect occurrence of a traffic incident, as discussed above with respect to the second agent in FIG. 1. Similarly, the data acquisition agent 211 is configured to collect data from local sensors as discussed above with respect to the first agent in FIG. 1.

The cognitive snapshot device 200 is coupled to a plurality of local sensors located on the same vehicle as the cognitive snapshot device 200 via the input/output (I/O) device interface 250. The cognitive snapshot device 200 can also be coupled, via the I/O device interface 250, to one or more I/O user interface devices, such as, but not limited to, a display screen, speakers, keyboard, mouse, keypad, touchpad, trackball, buttons, light pen, or other pointing devices. The snapshot instructions 203 are configured, in some embodiments, to cause the CPU 205 to output signals and commands via the I/O device interface 250 to provide a visual and/or audio prompts to request input from a user. For example, the snapshot instructions 203 can cause the CPU 205 to output an audio prompt to determine if a driver is disabled, as discussed above. Additionally, in some embodiments, the cognitive snapshot device 200 can be coupled to one or more external sensors, data sources, and/or a recommendation server over a network via the network interface 215, as discussed above.

Figure 3:
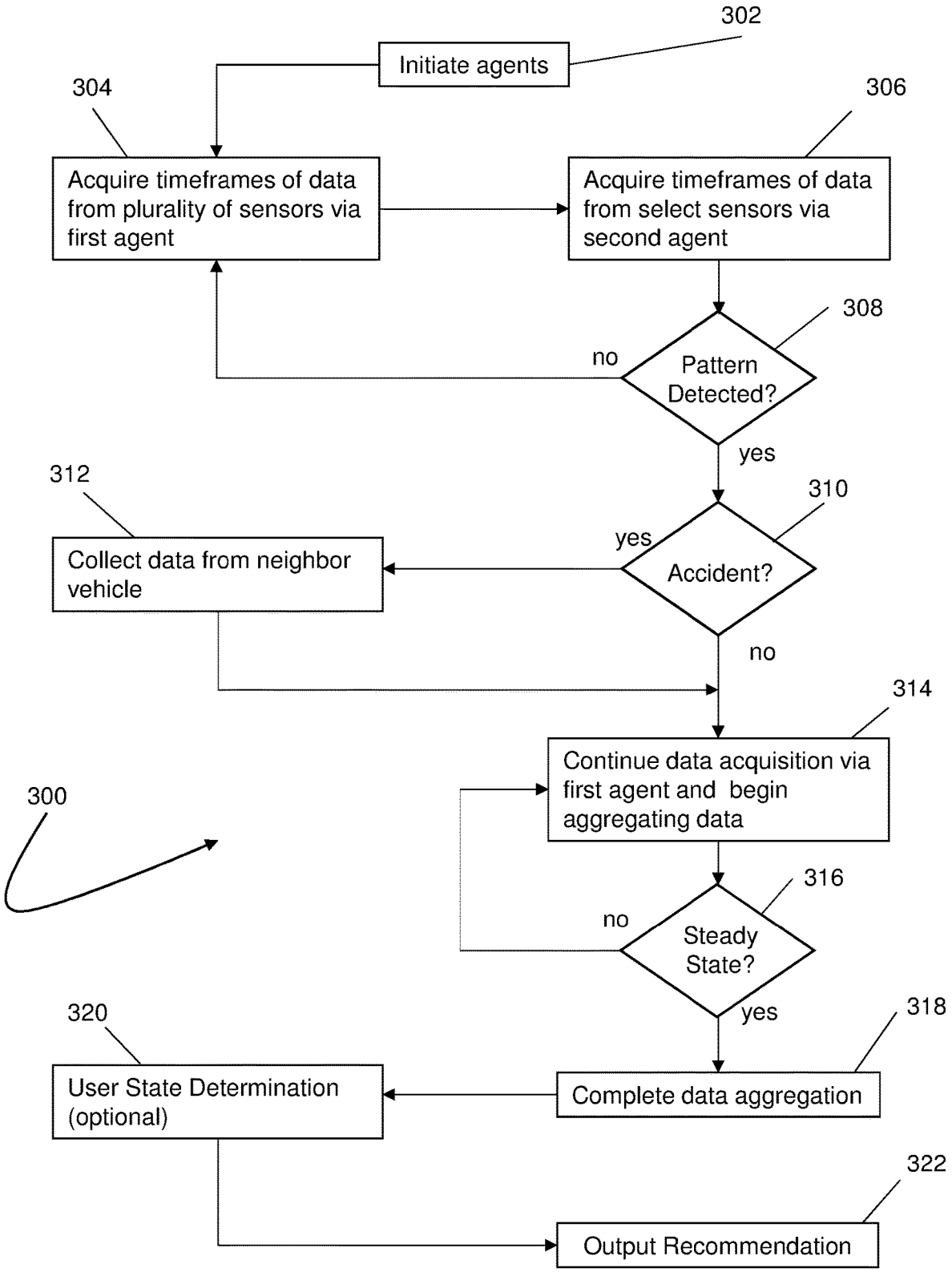
FIG. 3 is a flow chart of one embodiment of an example method of traffic incident assistance using snapshot triggering.

FIG. 3 is a flow chart of one embodiment of an example method 300 of traffic incident assistance using snapshot triggering. The method 300 can be implemented by a cognitive snapshot device, such as cognitive snapshot device 102 or 200 described above. For example, the method 300 can be implemented by a CPU, such as CPU 205 in cognitive snapshot device 200, executing instructions, such as snapshot instructions 203. It is to be understood that the order of actions in example method 300 is provided for purposes of explanation and that actions of method 300 can be performed in a different order or simultaneously, in other embodiments. For example, although discussed sequentially, the operations of blocks 310-314 can occur substantially simultaneously in some embodiments. Similarly, it is to be understood that some actions can be omitted, or additional actions can be included in other embodiments.

At block 302, a first agent (also referred to herein as a data acquisition agent) and a second agent (also referred to herein as an incident determination agent) are initiated. For example, the first and second agents can be loaded into memory for execution and variables used by the first and second agents can be initiated. Initiation of the agents occurs in response to the vehicle being started. Additionally, in response to starting the vehicle's engine, the local sensors can be started and initiated, and internet connectivity can optionally be established, as understood by one of skill in the art.

At block 304, the first agent begins acquiring data from each of a plurality of local sensors in response to detecting that the vehicle has begun moving. As discussed above, the first agent acquires the data in timeframes (also referred to herein as windows). The size of the windows can be configured or adjusted, in some embodiments. Also, in some embodiments, the first agent uses storage algorithms to store the most recent data and delete older data, as discussed above, such that the most recent data is maintained in memory. In some embodiments, for example, the first agent can be configured to store only the 5 most recent timeframes of data. However, in other embodiments, the first agent can be configured to store more than 5 or less than 5 timeframes of data. By limiting the amount of timeframes stored at any given point time, the amount of processing power and time required to analyze the data is reduced. Additionally, the system requires less storage space to store the acquired sensor data as compared to storing all of the acquired data over the course of time.

At block 306, the second agent begins acquiring data from a subset of the plurality of local sensors at approximately the same time as the first agent. In other words, the second agent does not collect data from all of the plurality of sensors. As discussed above, the second agent also acquires data from the subset of the sensors in timeframes or windows. It is to be understood that the size of the timeframes used by the second agent are not necessarily the same as the size of the timeframes used by the first agent. In other words, in some embodiments, the first and second agents capture data using timeframes of the same size, whereas, in other embodiments, the first agent uses timeframes having a first size and the second agent uses timeframes having a second size different from the first size. The second agent can also be configured to use a storage algorithm, as discussed above, in order to maintain only the most recent data acquired in memory. The second agent can be configured to keep the same number of timeframes as the first agent, in some embodiments, or a different number of timeframes than the first agent, in other embodiments.

At block 308, the second agent determines if a pattern indicating a traffic incident has been detected. For example, the second agent can analyze audio data to detect a siren, video data to identify flashing lights on a police vehicle, and/or impact data to detect an impact with another vehicle. Other data can also be used to detect a traffic incident. The pattern can be identified or detected by comparing the data collected to stored data known to be associated with a traffic incident, in some embodiments. This data can also be used to determine the type of traffic incident. For example, the data can be used to determine if an accident has occurred or if the vehicle is being stopped by a police vehicle, such as for a traffic violation.

At block 310, it is determined if the traffic incident is an accident based on the data collected by the second agent, as discussed with respect to block 308. If an accident has occurred, then data regarding the second vehicle is obtained at block 312, as discussed above. For example, data can be obtained directly from the other vehicle(s) if equipped for communication between the vehicles, from external sensors (e.g. cameras near traffic lights) and/or from local sensors (e.g. local cameras on the vehicle).

At block 314, data acquisition by the first agent is altered. In particular, the first agent is configured to store all acquired data from the time the traffic incident was detected until a steady state is identified at block 316. A steady state refers to when the vehicle has stopped moving. Thus, rather than using an algorithm to discard older data and store newer data, as discussed above, the first agent maintains the configured number of stored timeframes of data up to detection of the traffic incident (e.g. 5 timeframes, 10 timeframes, etc.) and aggregates to those stored timeframes data obtained from the plurality of local sensors from the detection of the traffic incident until the vehicle stops moving.

In this way, performance of subsequent analysis can be improved while still achieving the benefits discussed above of limiting the amount of data that needs to be stored and analyzed versus storing and analyzing all obtained sensor data. For example, rather than storing and analyzing all data obtained over the course of time, the storing algorithm limits the amount of data stored by deleting the oldest data as new data is obtained. However, such an algorithm could cause data corresponding to a point in time just before a traffic incident to be deleted as new data is obtained after the traffic incident. Thus, by freezing the timeframes of data captured just prior to detection of the traffic incident and aggregating to that data, data acquired while the vehicle is slowing to a stop, relevant data before and after a traffic incident can be processed to improve recommendations, such as, but not limited to, identifying fault for an accident.

In response to determining, at block 316, that the vehicle has reached a steady state, the aggregation of data is completed at block 318. In some embodiments, in addition to aggregating data obtained from local sensors, the cognitive snapshot device can acquire data from one or more data sources, such as data sources 114, or other sensors, such as sensors 110, while the vehicle is slowing to a stop if a network connection available, as discussed above.

At block 320, the state of a user (e.g. passenger or driver) is optionally determined. For example, if the vehicle is equipped with a speaker and microphone, an audio prompt can be generated asking for the user to make a sound to indicate the user is conscious or awake. If the user is conscious or awake, additional audio prompts can be generated. For example, the user can be prompted to provide a pre-established password, phrase and/or name. If the user does not provide the pre-established response, then the cognitive snapshot device can determine that the user is disabled or disoriented. Additional details regarding example embodiments of determining the state of a user are discussed in the co-pending U.S. patent application Ser. No. 15/703,858.

At block 322, a recommendation, based on the aggregated data, is output regarding the traffic incident. For example, in some embodiments, outputting the recommendation includes analyzing the aggregated data by the cognitive snapshot device to generate a recommendation. Additional details regarding example embodiments of generating a recommendation are discussed in more detail in the co-pending U.S. patent application Ser. No. 15/703,858. In other embodiments, outputting the recommendation includes outputting the aggregated data to a recommendation server and then providing a recommendation received from the recommendation server to one or more users.

Recommendations, as used herein, include suggested responses or courses of action to take in response to the traffic incident. In addition, providing a recommendation can include, in some embodiments, providing different respective recommendations to each of a plurality of users based on the type of user. For example, a first recommendation can be generated and output to a law enforcement officer (e.g. a recommendation including one or more of fault information and citation suggestions) while a second, different recommendation is generated and output for emergency medical personnel (e.g. a recommendation including treatment suggestions for an injured individual). Additionally, a recommendation can be provided to a driver of the vehicle (such as to contact law enforcement, exchange insurance information, etc.). The different recommendations can be provided to the respective users at different times, in some embodiments, such as based on when the respective users are within a predetermined proximity to the vehicle. One embodiment of an example method of providing the one or more recommendations is discussed in more detail below with respect to FIG. 4.

Figure 4:
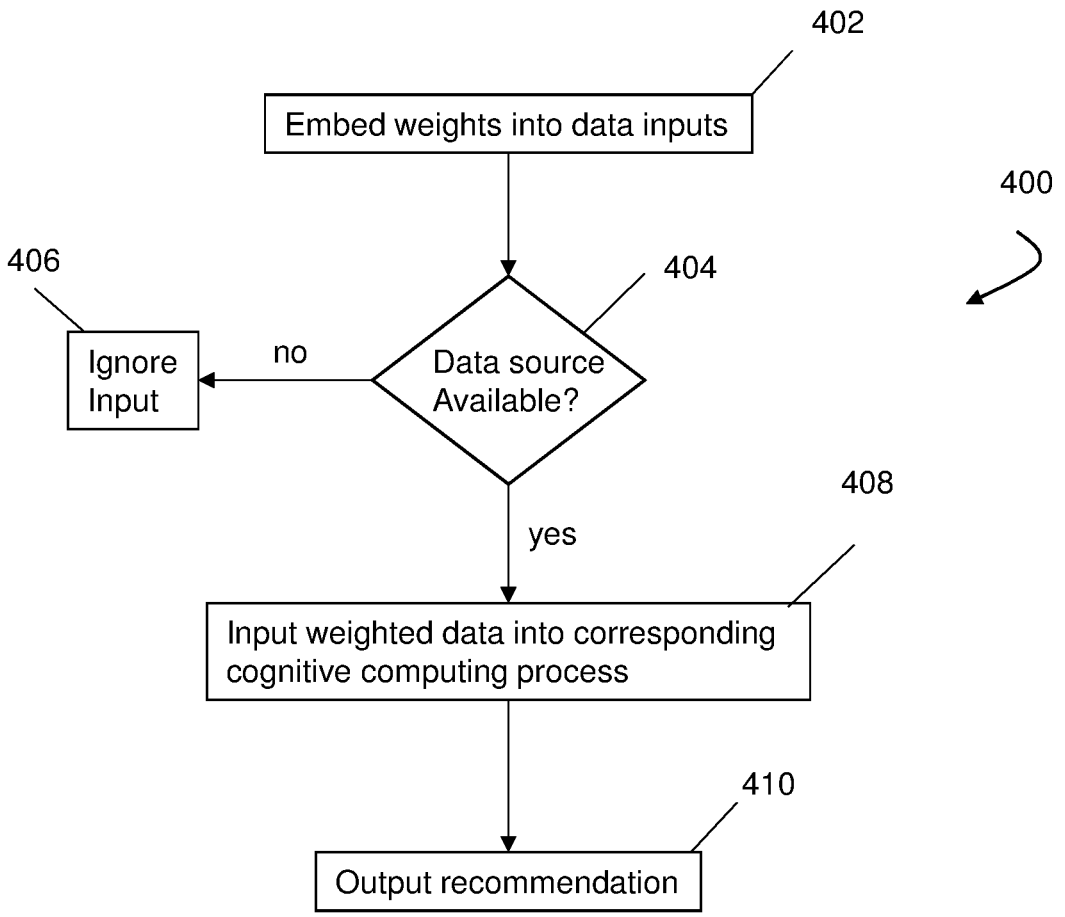
FIG. 4 is a flow chart of one embodiment of an example method 400 of providing a recommendation.

FIG. 4 is a flow chart of one embodiment of an example method 400 of providing a recommendation. Method 400 can be implemented as part of operation 322 discussed above. Additionally, method 400 can be implemented by a cognitive snapshot device, such as cognitive snapshot device 102 or 200 described above. For example, the method 400 can be implemented by a CPU, such as CPU 205 in cognitive snapshot device 200, executing instructions, such as recommendation instructions 201. It is to be understood that the order of actions in example method 400 is provided for purposes of explanation and that actions of method 400 can be performed in a different order or simultaneously in other embodiments. Similarly, it is to be understood that some actions can be omitted, or additional actions can be included in other embodiments.

At block 402, weights are embedded into data inputs based on the type of traffic incident determined, at block 308, by the incident determination agent. For example, the cognitive snapshot device can access a database of weights either locally or over a network connection. The database of weights includes respective predetermined weights to be applied to corresponding data inputs based on the type of traffic incident. For example, the data inputs can include, but are not limited to, data from wearable devices, audio data, data from nearby vehicles, speed limit data, GPS location data, traffic cameras, vehicle cameras, accelerometer data, speedometer data, etc. Thus, at block 402, weights are applied to the different data inputs such that data which is more relevant to the identified type of traffic incident are weighted more than data inputs which are less relevant.

At block 404, it is determined if the respective data source for each of the corresponding data inputs is available. That is, a weight can be applied at block 402 to a data input for which the data source is not available. For example, in a situation where the cognitive snapshot device does not have access to traffic camera data due to a lack of network connectivity, the data source for the traffic camera data is not available despite a weight being applied to the data input. If the respective data source for a given corresponding data input is not available, then the corresponding data input is ignored or excluded from subsequent processing at block 406. For each data input which has a respective available data source, the corresponding weighted data is input into cognitive computing processes, at block 408, to compute one or more recommendations. Additional details regarding cognitive computing processes to compute a recommendation are discussed in more detail in the co-pending U.S. patent application Ser. No. 15/703,858.

At block 410, a respective recommendation is output to one or more users, as discussed above. By weighting the data inputs based on the type of traffic incident and excluding data inputs which do not have an available data source, the cognitive snapshot device is able to generate improved recommendations by adjusting the data inputs based on relevance and availability prior to performing the cognitive processes.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A method comprising:

acquiring data, via a first software agent executed by a processor, from each of a plurality of local sensors located on a vehicle in response to detecting that the vehicle has begun moving, wherein the first software agent is configured to acquire the data from each of the plurality of local sensors in windows having a first window size, wherein the first software agent is further configured to delete older windows of data as newer windows of data are acquired such that only a pre-determined number of windows of data are stored based on when the windows of data are acquired;

acquiring data, via a second software agent executed by the processor, from each of a subset of the plurality of local sensors, wherein the second software agent is configured to acquire the data from each of the subset of the plurality of local sensors in windows having a second window size;

detecting a pattern in the data acquired via the second software agent from the subset of the plurality of local sensors, the pattern indicating a traffic incident;

in response to detecting a pattern indicating the traffic incident, aggregating all data acquired via the first software agent from a time when the pattern was detected until motion of the vehicle stops with the pre-determined number of windows of data stored at the time when the pattern was detected, wherein the first software agent is configured to not delete any of the windows of data in the pre-determined number of windows of data stored at the time when the pattern was detected in response to aggregating the data acquired via the first software agent from the time when the pattern was detected until motion of the vehicle stops; and outputting one or more recommendations related to the traffic incident to one or more users based on analysis of the aggregated data.

2. The method of claim 1, wherein the first window size is different from the second window size.

3. The method of claim 1, wherein detecting the pattern includes determining a traffic incident type indicated by the pattern.

4. The method of claim 3, wherein outputting the one or more recommendations comprises:

embedding weights into data inputs based on the traffic incident type indicated by the pattern; and generating the one or more recommendations based on the weighted data inputs.

5. The method of claim 3, wherein determining the traffic incident type comprises determining that the traffic incident type is a collision; and wherein the method further comprises collecting data regarding one or more neighbor vehicles in response to determining that the traffic incident type is a collision.

6. The method of claim 1, wherein providing the one or more recommendations comprises providing a respective recommendation to each of a plurality of users based on a respective user type of each of the plurality of users.

7. The method of claim 1, further comprising:

in response to detecting a pattern in the data acquired via the second software agent, acquiring data from one or more external sensors via a network connection from the time when the pattern was detected until motion of the vehicle stops; and aggregating the data acquired from the one or more external sources to the data acquired from the plurality of local sensors via the first software agent.

8. A system comprising:

a plurality of local sensors located on a vehicle;

a memory located on the vehicle; and a processing unit located on the vehicle, the processing unit communicatively coupled to each of the plurality of local sensors and to the memory, wherein the processing unit is configured to execute a first software agent configured to acquire data from each of the plurality of local sensors in timeframe increments having a first size, wherein the first software agent is configured to delete older timeframe increments of data as newer timeframe increments of data are acquired such that only a pre-determined number of timeframe increments of data are stored based on when the timeframe increments of data are acquired;

wherein the processing unit is further configured to execute a second software agent configured to acquire data from each of a subset of the plurality of local sensors in timeframe increments having a second size;

wherein the processing unit is further configured to:

detect a pattern in the data acquired via the second software agent from the subset of the plurality of local sensors, the pattern indicating a traffic incident;

in response to detecting a pattern indicating the traffic incident, aggregate all data acquired via the first software agent from a time when the pattern was detected until motion of the vehicle stops with the pre-determined number of timeframe increments of data stored at the time when the pattern was detected, wherein the first software agent is configured to not delete any of the pre-determined number of timeframe increments of data stored at the time when the pattern was detected in response to aggregating the data acquired via the first software agent from the time when the pattern was detected until motion of the vehicle stops; and output one or more recommendations related to the traffic incident to one or more users based on analysis of the aggregated data.

9. The system of claim 8, wherein the first size is different from the second size.

10. The system of claim 8, wherein the processing unit is configured to determine a traffic incident type indicated by the pattern.

11. The system of claim 10, wherein the processing unit is further configured to:

embed weights into data inputs based on the determined traffic incident type; and generate the one or more recommendations based on analysis of the weighted data inputs.

12. The system of claim 10, wherein the determined traffic incident type is a collision; and wherein the processing unit is further configured to collect data regarding one or more neighbor vehicles in response to determining that the traffic incident type is a collision.

13. The system of claim 8, wherein the processing unit is configured to output a respective recommendation to each of a plurality of users based on a respective user type of each of the plurality of users.

14. The system of claim 8, wherein the system further comprises a network interface and wherein the processing unit is further configured to:

acquire data from one or more external sensors via the network interface from the time when the pattern was detected until motion of the vehicle stops, in response to detecting a pattern in the data acquired via the second software agent; and aggregate the data acquired from the one or more external sources to the data acquired from the plurality of local sensors via the first software agent.

15. A computer program product comprising a computer readable storage medium having a computer readable program stored therein, wherein the computer readable program, when executed by a processor, causes the processor to:

acquire data, via a first software agent, from each of a plurality of local sensors located on a vehicle in timeframe increments having a first size;

store only a pre-determined number of timeframe increments of data acquired via the first software agent based on when the timeframe increments of data are acquired, wherein older timeframe increments of data are replaced by newer timeframe increments;

acquire data, via a second software agent, from each of a subset of the plurality of local sensors in timeframe increments having a second size;

detect a pattern in the data acquired via the second software agent from the subset of the plurality of local sensors, the pattern indicating a traffic incident;

in response to detecting a pattern indicating the traffic incident, aggregate the pre-determined number of timeframe increments of data stored at the time when the pattern was detected with data acquired via the first agent from a time when the pattern was detected until motion of the vehicle stops, wherein none of the pre-determined number of timeframe increments of data stored at the time when the pattern was detected are replaced by the data acquired via the first agent from the time when the pattern was detected until the motion of the vehicle stops;

acquire data from one or more external sensors via a network connection from the time when the pattern was detected until motion of the vehicle stops, in response to detecting a pattern in the data acquired via the second software agent;

aggregate the data acquired from the one or more external sources to the data acquired from the plurality of local sensors via the first software agent;

determine a traffic incident type indicated by the pattern is a collision;

collect data regarding one or more neighbor vehicles in response to determining that the traffic incident type is a collision;

collect data from a traffic signal system in response to determining that the traffic incident type is a collision;

embed weights into data inputs based on the determined traffic incident type; and output a different recommendation to each of a plurality of users based on a respective user type of each of the plurality of users and analysis of the weighted data inputs.

* * * * *